United States Patent [19]

Gillespie et al.

[11] 4,074,808

[45] Feb. 21, 1978

[54] SORTING APPARATUS

[75] Inventors: Robert M. Gillespie, Grand Rapids; John R. Ricks, Grand Ledge, both of Mich.

[73] Assignee: Cypro Corporation, Grand Rapids, Mich.

[21] Appl. No.: 681,411

[22] Filed: Apr. 30, 1976

[51] Int. Cl.[2] ..... B07C 5/342

[52] U.S. Cl. ..... 209/73; 209/74 R; 209/111.6; 209/111.7 R; 239/592; 250/237 R; 356/173

[58] Field of Search ..... 209/73, 74, 111.6, 111.7 R, 209/115; 250/237, 223 R, 239; 239/592, 593; 356/191, 194, 201, 173

[56] References Cited

U.S. PATENT DOCUMENTS

| | | | |
|---|---|---|---|
| 2,803,754 | 8/1957 | Cox | 209/111.6 X |
| 3,066,797 | 12/1962 | Fraenkel | 209/111.6 |
| 3,382,975 | 5/1968 | Hoover | 209/74 X |
| 3,735,143 | 5/1973 | Langford | 250/226 |
| 3,738,484 | 6/1973 | Hoover et al. | 209/111.6 X |
| 3,936,189 | 2/1976 | DeRemigis | 209/111.6 X |
| 3,939,983 | 2/1976 | Asfour | 209/111.6 X |
| 3,945,915 | 3/1976 | Wilson | 209/115 X |

*Primary Examiner*—Robert B. Reeves
*Assistant Examiner*—Joseph J. Rolla
*Attorney, Agent, or Firm*—Price, Heneveld, Huizenga & Cooper

[57] ABSTRACT

Optical sorting apparatus wherein during sorting, articles are directed to free fall through an illuminated inspection chamber. A light reflecting background positioned in the chamber is adjustable to form a variable reference standard of reflectivity. A sensor positioned to receive light from the background establishes a reference level and also receives reflected light from objects passing through the chamber. A change in detected light level from the reference level is indicative of a property of an article to be sorted for selectively effecting sortation of the article.

17 Claims, 9 Drawing Figures

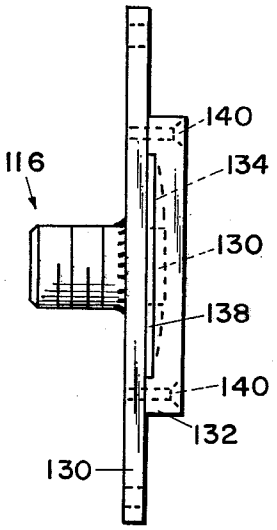
FIG 8
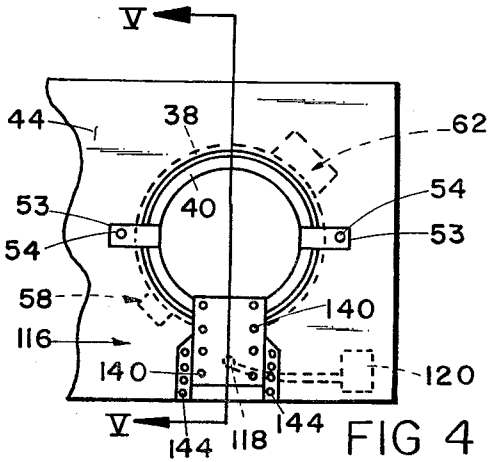
FIG 4
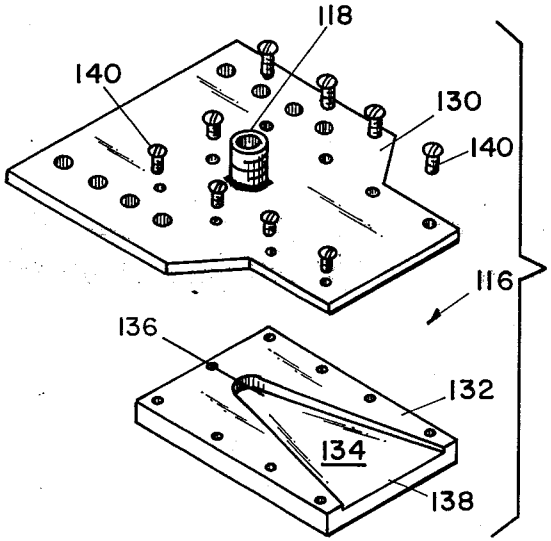
FIG. 7
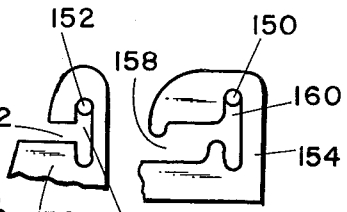
FIG 2b
FIG 2a
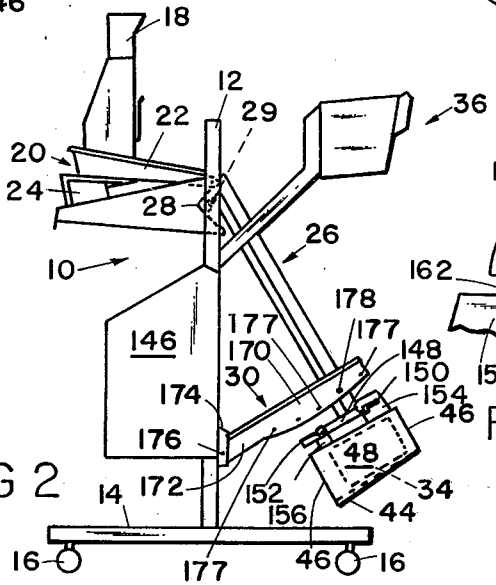
FIG 2
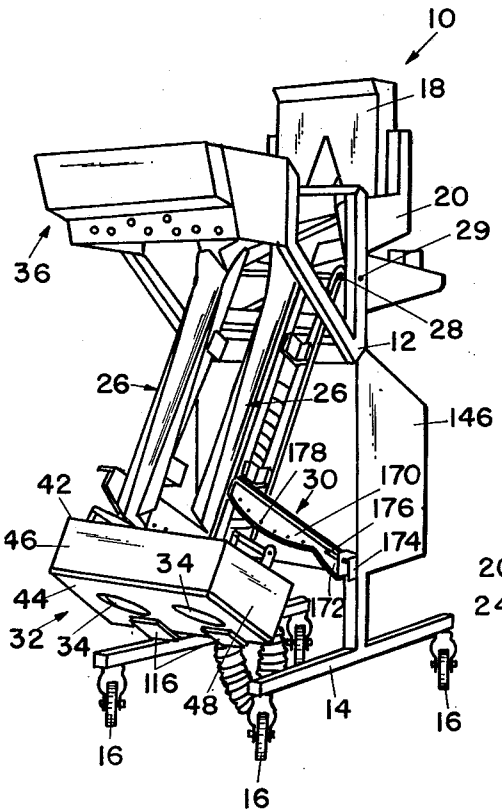
FIG 1

SORTING APPARATUS

BACKGROUND OF THE INVENTION

This invention relates to the sortation of articles such as food products in accordance with the color of the product as compared to a reference standard while the article free falls through an illuminated inspection chamber.

The typical prior art color sorting apparatus utilizes a reference or background of predetermined reflectivity arranged in the same plane as a sensor which measures reflected light from both the background and the articles passing through the sorting apparatus. The reference level at which sortation takes place is determined by a comparison of light reflected from the article to the light reflected from the reference or background. When no product is in the optical plane of the sensor, the electrical condition of the sensor is returned to the level determined by the reference and all objects being sorted are measured from that level. Typically, a reference level is chosen from which desirable objects produce either no change or a change in condition of the circuitry opposite to the change produced by an undesirable object. As the color or reflectivity of the objects being sorted changes, it is quite often necessary to change the reference level to maintain the proper balance for correct sorting. Typically, this is done by replacing a reference background with a background of appropriate color or reflectivity for the objects being sorted. This method has the disadvantage, however, of requiring the selective use of several of the various references which are colored in steps or ranges. Further, the changing of the reference requires significant effort and time during which the sorting apparatus is not operating.

In another system for varying the reference level, the reference background may be moved toward or away from the light source so that the intensity of the light reflected from the background varies. Since light energy decreases as the square of the distance from the background, the system is not linear and therefore it is difficult to establish the proper reference level before effective sorting operations can commence.

Another approach known in the prior art is to vary the angle of the reference with respect to the plane of the sensor and the light source. This method is difficult to control since the position of the light source and the surface characteristics of the reference cause irregular nonlinear changes in the light directed to the sensor.

Further, in such sorting of articles, particularly food objects, the freefall trajectory of the article through the inspection port should be controlled to prevent the object from moving away from a predetermined path. As long as the apparatus is designed for use to inspect a specific product, the trajectory of that object can be planned for in the design of the apparatus. The resultant apparatus therefore is not conveniently adaptable to objects deviating from the characteristics of the object for which it is designed. Known prior art apparatus has not permitted convenient adjustment or control of the trajectory of an object through the inspection port to accommodate wet or dry objects or objects of different physical characteristics which affect their freefall trajectory.

Typically, articles which do not meet the desired standards are removed from the inspection chamber by means of a blast of fluid pressure from a nozzle. In the prior art, a nozzle directs a jet of fluid pressure, such as air, to strike and displace the object from the predetermined path in response to a signal from the detector. The positioning of the nozzle with respect to the path of the article is of extreme importance and if the nozzle and article are not in alignment then the jet of air cannot strike the article and the article will not be rejected.

SUMMARY OF THE INVENTION

According to one aspect of the present invention, a sorting apparatus includes a chamber or inspection port throug which articles to be sorted are individually passed and optically sorted. Means are provided for illuminating the chamber and a light reflecting background means is positioned in the chamber to form an adjustable reference standard of reflectivity. The reflecting means includes a first member having spaced segments of different light-reflecting characteristics and a second member positioned over the first having a series of spaced apertures formed therein. The apertures correspond generally to the light absorbing segments formed in the first member and drive means is provided for moving one of the members with respect to the other to adjust the reflectivity of the background surface by selectively exposing the segments through the apertures to establish a predetermined background level. A detector is positioned to receive light reflected from the background to establish a reference level and to receive light reflected from objects passing through the chamber. A change in detected light level from the reference level as the article passes is indicative of a property of an article to be sorted for effecting sorting of the article.

The inspection port or chamber has inlet and outlet ends through which the articles freely fall in a predetermined path generally along the length of the chamber. Downwardly depending directing means extends between a hopper to receive the articles and the chamber for directing the articles to the inlet end for free fall therethrough along the predetermined path. According to another aspect of the present invention, the directing means and chamber are adjustably mounted to vary the angular relationship with respect to the framework such that the trajectory of articles directed to free fall through the chamber can be adjusted to follow the predetermined path and thus accommodate articles of varying size, weight and surface characteristics.

According to still a further aspect of this invention, an improved nozzle is provided for use in the sorting apparatus whereby the nozzle is selectively employed to eject articles from a stream of articles passing through the chamber. The improved nozzle includes a housing having a chamber formed therein. The inlet portion of the chamber has a relatively deep narrow surface area while an outlet portion thereof tapers outwardly and has a relatively wide, thin surface area. Preferably, the cross-sectional area of the inlet portion is approximately equal to the cross-sectional area of the outlet portion to thereby maintain a constant velocity of air flow therethrough and to provide a wide blast of air at the outlet to thus insure that articles not meeting the standard are effectively removed from the chamber of the inspection port.

The present invention thus improves upon and overcomes the disadvantages of the above-noted prior art devices. Other important advantages and features of the invention will become readily apparent to those skilled in the art upon reading the following specifiction and with reference to the accompanying drawings.

BRIEF DESCRIPTION OF THE DRAWINGS

FIG. 1 is a perspective view of the sorting apparatus of the present invention;

FIG. 2 is a side elevation view of the sorting apparatus shown in FIG. 1;

FIGS. 2*a* and 2*b* are enlarged details of the mounting for the inspection assembly;

FIG. 4 is a partial view showing the bottom portion of the inspection port and nozzle assembly;

FIG. 7 is an enlarged, exploded view of the nozzle assembly for selectively rejecting articles from the stream of articles to be sorted;

FIG. 8 is an end view of the assembled nozzle assembly shown in FIG. 7; and

DESCRIPTION OF THE PREFERRED EMBODIMENT

Figures 3, 5, 6, 9:
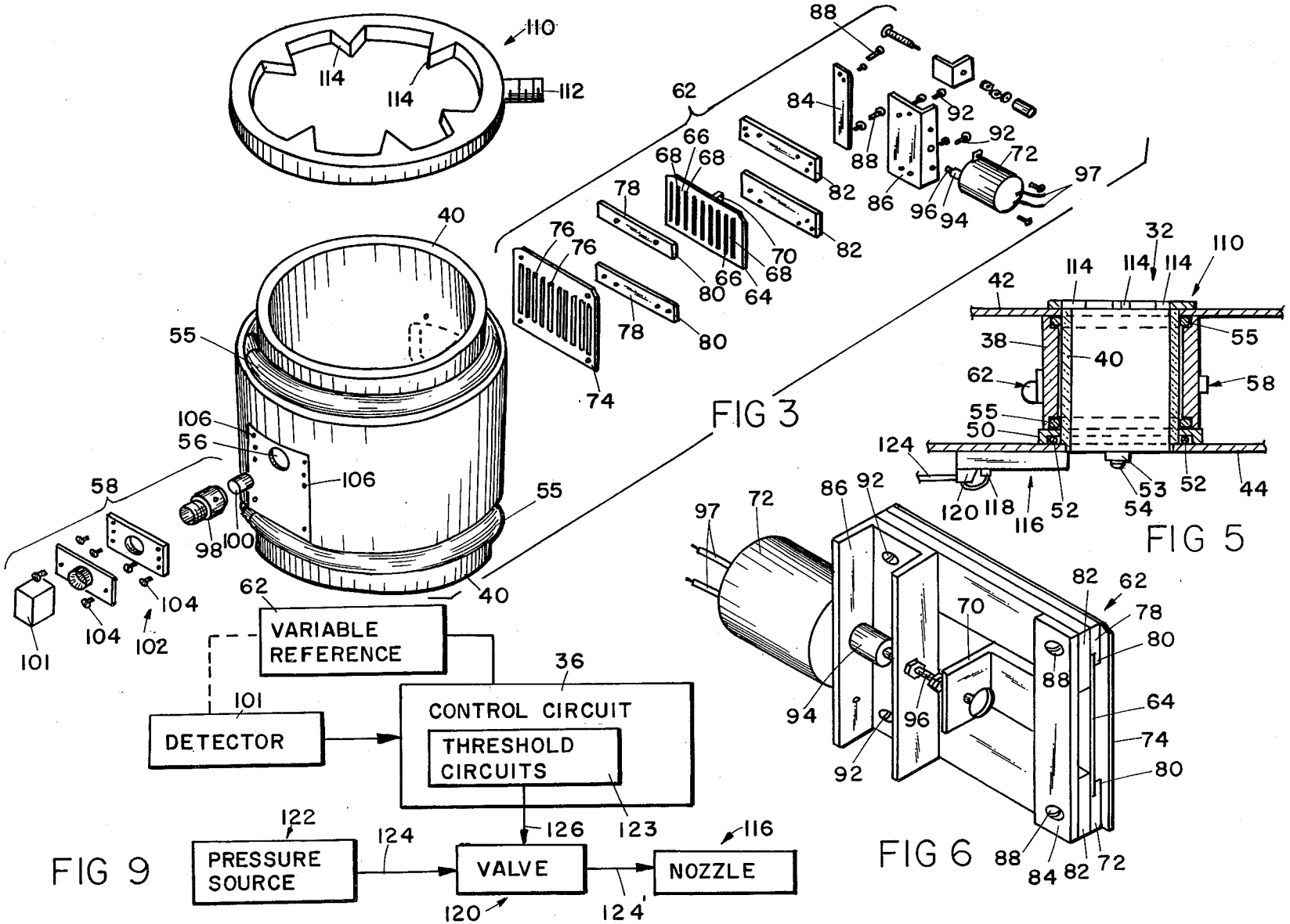
FIG. 3 is an enlarged, exploded view of the inspection port, illumination source, detecting means and adjustable reference background member.
FIG. 5 is a cross-sectional view of the inspection port taken generally along the plane V—V of FIG. 4.
FIG. 6 is a perspective rear view of the adjustable reference background members in an assembled relationship.
FIG. 9 is an electrical circuit and fluid flow diagram in block form of the control circuits for detecting and selectively rejecting objects.

Referring now to the drawings and in particular to FIGS. 1 and 2, the article sorting apparatus 10 of the present invention includes a supporting framework 12 upwardly extending from a base 14 which is mounted on casters 16 for portability of this unit. A receiving hopper 18 is positioned at the top of frame 12 to receive a quantity of articles to be sorted typically from a conveyor. A singulator assembly 20 including a pair of spaced vibratory trays 22 and a suitable vibrator drive 24 is positioned below the outlet end of hopper 18 to receive the articles and to discharge them in single row fashion from the trays 22 into a pair of spaced downwardly depending generally parallel directing means or chutes 26. Chutes 26 are pivotally suspended on the frame 12 by means of hooks 28 extending pivotally over a rod 29 extending transversely between the vertically extending frame members. Adjustment means 30 (described in greater detail below) is provided to adjust the angular relationship of chute 26 with respect to frame 12.

An inspection assembly 32 containing a pair of inspection ports or chambers 34 is removably and pivotally supported at the outlet end of chutes 26 such that articles under inspection will free fall therethrough. Inspection assembly 32 includes a pair of inspection ports 34 (FIG. 3) each containing suitable sensing means for detecting light reflecting properties of articles passing therethrough. A control panel 36 is positioned near the upper part of framework 12 for convenient access. The control panel containing the electronic control circuits is electrically coupled to the inspection assembly 32.

Inspection assembly 32 forms a generally box-like enclosure having an upper wall 42, a lower wall 44, front and rear walls 46 and side walls 48. A pair of spaced generally vertically extending inspection ports 34 are formed within the enclosure to extend between upper wall 42 and lower wall 44. With reference to FIGS. 3–5, one of the identical inspection ports will be described in greater detail. The inspection port includes an elongated annular outer housing 38 and a removable inner housing or sleeve 40. Sleeve 40 extends between the upper wall 42 and lower wall 44 and is secured therein by a retainer ring 50 positioned in bottom wall 44. O-ring seals 52 positioned on the inner surface of bottom wall 44 seal sleeve 40 with respect to walls 42 and 44. Clamping members 53 secured to the bottom wall extend inwardly toward the center of the chamber to hold the sleeve in place. Screws 54 holding the clamps can be removed so that the sleeve can be removed for service and the like. Sleeve 40 is formed of transparent material, for example, clear plastic and forms a liner for the inspection port to isolate the electrically operated components from the stream of products passing through the port while providing an optical path therethrough.

Illuminating means, preferably a pair of annular fluorescent light tubes 55, are positioned at the upper and lower ends of housing 38 adjacent the inner surfaces of walls 42 and 44 and surround an exposed portion of transparent sleeve 40. When energized, the annular light tubes uniformly illuminate the interior of the inspection chamber 34. The transparent sleeve also serves as a light guide dispersing the light from the annular fluorescent tubes to completely illuminate the inspection chamber and articles passing therethrough.

As shown in FIG. 3, an opening 56 is provided in wall 38 at one side of the chamber to receive detector assembly 58. Directly opposite opening 56 an elongated opening 60 is provided to receive an adjustable light reference background assembly 62.

With reference to FIGS. 5 and 6, the adjustable background assembly 62 includes a first rectangular member 64 having spaced segments 66 of different light reflecting characteristics formed thereon. Preferably, alternate light reflecting and light absorbing bands are formed thereon. Each spaced segment 66 may be formed by a stripe of black paint which forms a light absorbing surface painted on the surface of plate member 64 and the alternate spaces 68 between each absorbing band is of a reflecting nature such as white paint. The first member has an outwardly extending tab 70 formed thereon which, as will be hereinafter described, is adapted for connection to a drive motor 72 for adjustment purposes. A second rectangular member 74 is positioned over the first member and has a series of spaced apart apertures 76 formed therein which correspond generally to the width of each light absorbing band 66 formed on the first member. The face of member 74 facing the detection assembly is black in the preferred embodiment such that the reference background may be adjusted from total black to approximately 50 percent white.

The first and second members are mounted for sliding movement with respect to one another in a supporting frame which includes a first pair of spacers 78 having tabs 80 formed thereon which, when assembled with a second pair of spacers 82, form a guideway to slidably receive first member 64. A transverse clamping member 84 and a combined clamp and motor mount 86 are positioned adjacent spacers 82. Fastening screws 88 are passed through suitable openings in clamp 84, blocks 82 and 78 and into threaded openings 90 formed in the sidewall of outer housing 38 adjacent opening 60. Similarly, clamp and motor mount 86 is provided with suitable openings through which screws 92 extend through mounting blocks 82 and 78 and into corresponding threaded openings (not shown) adjacent opening 60. Clamp and motor mount 86 is also adapted to receive drive motor 72 which is secured thereon in a conventional manner. Shaft 94 of motor 72 includes a threaded portion 96 which extends through and threadably engages tab 70 on first member 64. Motor 72 is electrically connected via suitable lead wires 97 to the electrical circuitry contained in control panel 36. Operation of the motor in a first direction will cause member 64 to move in a first direction with respect to the second member while rotation of the motor in the opposite direction will correspondingly move member 64 in the opposite direction. This will change the relative positions of the alternate light and dark bands 66 and 68 of the first member with respect to the apertures 76 formed in second member 74 causing the surface exposed through opening 60 in the chamber in a shutter-like fashion to reflect more or less light to the detector 58.

Although the face of member 74 is described as black in color to absorb light, the face may be provided with a light reflecting surface, as white, such that adjustment may be made with plate member 64 to attain a total white background to approximately 50 percent black. Other colors may be selected to absorb and reflect light as required depending upon the product being sorted. Similarly, transparent plate members having opaque surface areas formed thereon to control the amount of light passing therethrough may also be utilized.

Light detector assembly 58, as previously mentioned, is positioned opposite the reference background surface 62 in housing 38. The detector assembly is of conventional construction and includes a lens and filter 100, detector 101 and suitable mounting means 102 therefor. Mounting means 102 is held in position by screws 104 received in threaded openings 106 adjacent opening 56 in the sidewall of housing 38. Although a single lens and filter 100 is shown, it will be appreciated by those skilled in the art that different filters can be substituted to vary the sensitivity depending upon the color of the object being sorted. The detector is positioned to receive light reflected from background assembly 62 and objects passing through the chamber.

While a single reference background assembly 62 and detector assembly 58 are shown positioned on opposite sides of the inspection chamber, two or preferably three such assemblies may be used in connection with each inspection chamber. In this case, it is preferable to space them equally, that is, 120° around the diameter of the inspection chamber.

A ring-like nozzle assembly 110 is positioned at the uppermost end of the transparent sleeve and includes a fitting 112 for connection to a source of liquid as water or similar cleaning fluid. The ring nozzle assembly 110 includes a plurality of outlet orifices 114 which extend to direct a spray of liquid downwardly along the inner walls of the transparent sleeve 40. Fluid introduced to the ring nozzle assembly, when outletting at orifices 114, will serve to keep the interior walls of the transparent sleeve clean.

An ejection nozzle assembly 116 (FIGS. 7 and 8) is positioned adjacent the outlet portion of each inspection port 34 and includes an inlet fitting 118 adapted for connection through suitable electrically actuated valve means 120 (FIGS. 4 and 5) to a source of fluid pressure 122 (FIG. 9). Valve 120 is a conventional solenoid valve and is connected in a line 124—124' (FIG. 9) between the nozzle and a source of fluid pressure 122. Solenoid valve is operated in a conventional manner by means of suitable electronic circuitry contained in control panel 36. The controls include conventional threshold circuit 123 coupled to the detector 98 for receiving electrical signals therefrom and for generating an output control signal at conductor 126 for actuating valve 120 to effect ejection of a defective article from the stream of articles passing through the inspection port. The control circuits 36 are conventional employing commercially available integrated circuits.

As shown in FIGS. 7 and 8, ejection nozzle assembly 116 comprises a two-piece housing including a cover 130 and a base 132. Base 130 has a chamber 134 formed therein which includes an inlet portion 136 and an outlet portion 138. The inlet portion of the chamber has a relatively narrow, deep surface area located, when assembled, directly below fitting 118 in the cover 130. The chamber tapers outwardly from inlet 136 toward outlet 138. The outlet 138 as viewed in FIG. 8 is seen to be relatively wide and thin. Preferably, the cross-sectional area of the narrow and deep inlet portion is approximately equal to the cross-sectional area of the wide and thin outlet portion to thereby maintain a constant pressure and flow velocity from the inlet to the outlet of the nozzle assembly. A plurality of screws 140 extend through suitable openings formed in cover 130 and are received in suitable threaded openings 142 spaced around base 132. Nozzle assembly 116 is secured to bottom wall 44 of the inspection chamber by means of screws 144 (FIG. 4) received in bottom wall 44 of the inspection assembly such that outlet end 138 of the nozzle faces inwardly toward the center of the inspection chamber to direct a blast of fluid pressure over the outlet opening of the inspection port to thus remove undesired articles from the predetermined path. Screws 140 permit the nozzle to be adjusted toward and away from the inspection port.

As shown in FIG. 4 and in the schematic view of FIG. 9, nozzle 116 is connected via lines 124—124' and valve 120 to the fluid pressure source 122. Preferably, valve 120 is contained within inspection assembly 32 and is operatively connected for operation by the circuits in control panel 36. Fluid pressure source 122 which may include a compressor (not shown) may be contained within a housing 146 supported on framework 12. Housing 146 may also contain a suitable source of liquid and associated pressure source to provide the cleaning liquid directed by ring nozzle assembly 110 and orifices 114 over transparent sleeve 40 within the inspection chamber.

With reference again to FIGS. 2, **2*a* and 2*b*, it will be noted that inspection assembly 32 is secured to the end of the chutes or directing means 26. A pair of bracket members 148 are secured at the ends of the chute 26 to extend generally perpendicular thereto. Bracket members 148 are positioned at each side of the chute 26 and each include a pair of outwardly extending pins 150 and 152 to which a corresponding pair of brackets 154 and 156, respectively, are used to attach the inspection assembly 32 to the end of the chute. Bracket member 154 is formed with an elongated slot 158 having an upwardly extending elongated detent portion 160 which engages pin 150. Bracket 156 is formed with a slot 162 having a similar detent portion 164 to receive pin 152. Inspection assembly 32 may be conveniently removed from the chute 26 by lifting it slightly such that detents 160–162 release from the pins 150 and 152 and move outwardly through slots 158 and 162. For cleaning and other maintenance purposes, inspection assembly 32 may be released at only one side at pin 152 and pivoted or hinged downwardly about pin 150**. This greatly facilitates access to the interior of the inspection chamber for cleaning and like maintenance operations.

To accommodate articles of varying size or density and to insure the proper trajectory of the articles along the predetermined path through the axis of the inspection chamber, chutes 26 may be adjusted to differing angular relationships with respect to frame 12 through the utilization of the previously mentioned adjusting means 30. Adjusting means 30 includes a pair of outwardly extending arms or brackets 170 pivoted at one end 172 to framework 12 on a mounting bracket 174. A pin 176 extending through mounting bracket 174 pivotally supports the arm 170. An arcuate series of spaced openings 177 positioned along the outermost end of arm 170 match with a corresponding opening formed in the frame supporting chutes 26 such that the angular relationship of chutes 26 with respect to frame 12 may be adjusted to the desirable position. A pin 178 or other suitable fastening means extending through a selected opening 177 and through the opening provided in the chute fixes the chutes in the desired position. Accordingly, the angular relationship of chutes 26 may be adjusted as required while maintaining the angular relationship of the inspection assembly to achieve the proper trajectory of the article passing through the inspection port along the predetermined path generally along the axial center line of the inspection chamber.

OPERATION

In operation, a quantity of articles to be sorted such as cherries are fed into the hopper 18 where they are fed and arranged by the singulator assembly 20 into chutes 26 where they are directed to free fall through the inlet end of the inspection port. Prior to beginning the sortation process, a reference threshold level is established by operation of the controls to adjust the surface of the reference background assembly 62. During such adjustment, the control circuits 128 operate motor 72 as required to shift first member 64 with respect to the second member 74 and thus expose more or less of the reflecting surface to the detector assembly 58. The surface reflectivity of the reference background is thus selected to have a light reflecting capability similar to that of the desirable inspected article. This adjustment typically is affected by running the product through the unit and controlling motor 72 until the defective product is ejected from the product stream. As the article free falls through the inspection chamber, the signal detected, that is, produced by the article depends on the ability of the object to reflect light. If the article is flawed, that is, if it contains dark spots, for example, the signal detected by the sensor assembly deviates from the established threshold level and the threshold circuit activates valve 120. This, in turn, connects the fluid pressure source 122 to nozzle 116 and the jet of fluid pressure at outlet 138 ejects the article from the predetermined path through the inspection chamber. The good articles, in turn, fall onto an output conveyor (not shown) while the defective products can be caught by a container placed under the sorting unit.

The apparatus sorts in accordance with more or less light reflected from the article to be sorted as compared to a standard. Articles which reflect a predetermined level of light when compared to the reference have no effect whatsoever on the threshold circuits and thus the object is free to pass through the inspection chamber and into suitable conveying or container means.

When objects having basically the same characteristics but of a different color are to be sorted, compensating color filters may be positioned at the detector and corresponding adjustments may be made to the reference background. Similarly, when objects of greater or lesser weight which will not follow the necessary trajectory along the predetermined path through the inspection chamber are sorted, suitable adjustment may be made by pivoting the chute 26 about hook 28 and through the use of adjustment means 30.

Those skilled in the art will thus appreciate that an improved sorting device for optically sorting articles has been provided by the present invention. The invention not only provides an improved apparatus for changing the light reflecting characteristics of the reference background but additionally provides novel means adjustably mounting the directing means or chute and inspection means together for varying their angular relationship with respect to the framework so that the trajectory of articles directed to free fall through the inspection chamber will follow the predetermined path. Finally, an improved nozzle assembly for selectively ejecting articles from a stream of articles passing through the inspection chamber has also been provided.

While a preferred embodiment of the invention has been illustrated and described, it will be recognized that other embodiments and modifications of this invention incorporating the teachings hereof may be readily made in the light of this disclosure. Such modifications employing the principles of this invention will, however, fall within the scope of the appended claims.

The embodiments of the invention in which an exclusive property or privilege is claimed are defined as follows:

1. A sorting apparatus comprising a chamber including open ends through which articles to be sorted are individually passed for optically sorting the articles;

means for illuminating said chamber;

light reflecting background means positioned on the side of said chamber and forming an adjustable reference standard of reflectivity, said reflecting means including a first member having alternately spaced stripes of different light reflecting characteristics, a second member positioned over said first member and having a series of spaced slots formed therein, said slots corresponding generally to alternate spaced stripes formed on said first member, and means for moving one of said first and second members with respect to the other of said members to adjust the reflectivity of said background means by selectively exposing said segments through said apertures to establish a predetermined background level; and detection means positioned on said chamber opposite said background means to receive light reflected from said background means to establish a reference level and including, lens means focusing said detection means on objects passing through said chamber approximately midway between said detection means and said background means whereby a change in detected light level from said reference level is indicative of a property of an article to be sorted for effecting sorting of the article.

2. The sorting apparatus as defined in claim 1 whereby an ejecting nozzle is selectively employed to eject an article from a stream of articles for sorting the articles and wherein said nozzle includes a housing; a chamber formed in said housing, said chamber having an inlet and an outlet, said inlet of said chamber being relatively narrow and deep, said chamber tapering outwardly toward said outlet wherein said outlet is relatively wide and thin and wherein the cross-sectional area of said narrow and deep surface area is approximately equal to the cross-sectional area of said wide and thin area for maintaining a constant pressure and air flow through said nozzle.

3. In an article sorting apparatus for sorting articles by color comprising:

a framework;

means on said framework for supplying articles to be sorted;

an elongated inspection port having inlet and outlet ends through which the articles freely fall in a predetermined path generally along the axial length of said inspection port;

downwardly depending directing means extending between said supplying means and said inspection port for directing articles to said inlet end of said inspection port for free fall therethrough, said inspection port being supported on said directing means;

means adjustably mounting said directing means and said inspection port together for varying the angular relationship of said directing means with respect to said framework while maintaining a predetermined angular relationship with said inspection port whereby the trajectory of articles directed to free fall through said inspection port may be adjusted to follow said predetermined path, wherein said adjustable mounting means includes means pivotally mounting said directing means with respect to said framework and locking means for securing said directing means in adjusted position relative to said framework;

detecting means in said inspection port for detecting a property of articles passing therethrough; and means coupled to said detection means responsive to signals from said detection means for selectively removing articles varying from a pre-established standard from said predetermined path.

4. The article supporting means of claim 3 wherein said mounting means includes said directing means having hanger means formed at an upper end thereof and engaging means on said framework adapted to receive said hanger means and wherein said locking means includes an outwardly extending arm member on said frame having spaced apertures therein for selective cooperating locking engagement with the lower end of said directing means.

5. The apparatus as defined in claim 3 wherein said detecting means includes a target and wherein objects to be sorted are compared to a threshold reference level of illumination as detected by light responsive means, said target comprising;

a first member having alternate light reflecting and light absorbing segments formed thereon;

a second member having a series of spaced apart light transmitting and light blocking areas formed therein, said light transmitting areas corresponding generally to said light absorbing segments formed on said first member;

means mounting said first and second members for movement relative to each other wherein said light absorbing segments can be selectively exposed when aligned with said light transmitting areas and covered when not so aligned; and means for moving one of said first and said second members relative to the other of said members to thereby vary the threshold reference level of illumination detected by said light responsive means.

6. The apparatus of claim 5 wherein said series of light transmitting areas includes said second member having a series of spaced apart apertures formed therein corresponding generally to said light absorbing segments formed on said first member.

7. In an article sorting apparatus for sorting articles by color comprising:

a framework;

means on said framework for supplying articles to be sorted;

an elongated inspection port having inlet and outlet ends through which the articles freely fall in a predetermined path generally along the axial length of said inspection port;

downwardly depending directing means extending between said supplying means and said inspection port for directing articles to said inlet end of said inspection port for free fall therethrough, said inspection port being supported on said directing means;

means adjustably mounting said directing means and said inspection port together for varying the angular relationship of said directing means with respect to said framework while maintaining a predetermined angular relationship with said inspection port whereby the trajectory of articles directed to free fall through said inspection port may be adjusted to follow said predetermined path;

detecting means in said inspection port for detecting a property of articles passing therethrough;

means coupled to said detection means responsive to signals from said detection means for selectively removing articles varying from a pre-established standard from said predetermined path; and further including means removably and pivotally mounting said inspection port on said directing means whereby said detecting means may be removed from said directing means for service and maintenance.

8. The article sorting apparatus of claim 7 wherein said inspection port includes an elongated chamber; means for illuminating said chamber; and wherein said detecting means includes a light responsive sensor and a light reflecting reference surface means, said reference surface means having adjustment means for varying the light reflecting capabilities thereof whereby the threshold level of detection can be varied to accommodate articles of differing light reflecting characteristics.

9. The article sorting apparatus of claim 8 wherein said illuminating means includes annular fluorescent light producing means positioned adjacent said chamber for directing light into said chamber to illuminate articles passing therethrough.

10. The article sorting apparatus of claim 9 wherein said annular fluorescent light producing means is positioned adjacent each of said inlet and said outlet ends of said chamber.

11. A sortation apparatus for sorting objects in accordance with the light reflected by objects passing through an illuminated inspection port comprising: a framework; an inspection chamber opened at its top and bottom to provide a passageway therethrough for objects to be inspected;

downwardly depending means for dropping articles to be sorted through said inspection chamber, said dropping means including chute means extending between said inspection chamber and said framework and pivotally movable with respect to said framework and lockable in a desired position to selectively adjust the trajectory of objects passing through said inspection chamber optical light reference means mounted to said inspection chamber facing the passageway therethrough providing a comparison standard, light sensing means mounted to said inspection chamber opposite said light reference means and facing said reference means, and means for adjusting the light reference means to vary the comparison standard in accordance with the light reflecting characteristics of the object being sorted, said light reference means comprising a first member positioned with respect to said light sensing means and having a pattern thereon providing alternate light and dark surface areas; a second member positioned relative said first member, said second member having a plurality of spaced light transmitting areas thereon corresponding in width to the pattern on said first member; and means mounting said first and said second members for movement relative to one another to thereby vary the amount of dark surface exposed to said light sensing means through said light transmitting areas in said second member.

12. The improvement of claim 11 and further including control means for moving one of said first and said second members relative to the other of said members.

13. The improvement of claim 12 wherein said control means includes said first member being fixed relative to said light sensing means, said second member being slidably mounted with respect to said first member, driving means connected to said second member for moving same with respect to said first member, and circuit means for operating said driving means.

14. The improvement of claim 13 wherein said drive means comprises a reversible motor.

15. The improvement of claim 11 and further including;

rejecting means operatively connected to said sensing means for selectively rejecting objects moving through said inspection port.

16. The improvement of claim 15 wherein said rejecting means includes a nozzle member positioned adjacent an outlet portion of said inspection port, said nozzle means being adapted for connection to a source of fluid pressure; electrically actuated valve means connected to control the fluid pressure applied to said nozzle; and circuit means coupling said valve means to said detection means for controlling the actuation of said valve means.

17. The improvement of claim 16 wherein said nozzle means includes a housing; a chamber formed in said housing, said chamber having an inlet portion and an outlet portion, said inlet portion of said chamber having a relatively narrow, deep surface area, said chamber tapering outwardly toward said outlet portion, said outlet portion being relatively wide and thin wherein the cross-sectional area of said narrow and deep inlet is approximately equal to the cross-sectional area of said wide and thin outlet to maintain a constant pressure and air flow through said nozzle.

* * * * *